US011459992B1

(12) United States Patent
Montgomery

(10) Patent No.: US 11,459,992 B1
(45) Date of Patent: Oct. 4, 2022

(54) DELAY CIRCUIT FOR PROVIDING NATURAL GAS TO AN ENGINE AND SYSTEMS, ASSEMBLIES, AND METHODS THEREOF

(71) Applicant: Caterpillar Inc., Peoria, IL (US)

(72) Inventor: David T. Montgomery, Edelstein, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 17/347,595

(22) Filed: Jun. 15, 2021

(51) Int. Cl.

| | |
|---|---|
| ***F02N 9/04*** | (2006.01) |
| ***F02M 21/02*** | (2006.01) |
| ***F02D 41/00*** | (2006.01) |
| ***F02D 41/06*** | (2006.01) |
| ***F02D 19/02*** | (2006.01) |

(52) U.S. Cl.
CPC ..... *F02N 9/04* (2013.01); *F02D 19/021* (2013.01); *F02D 41/0027* (2013.01); *F02D 41/062* (2013.01); *F02M 21/0236* (2013.01); *F02M 21/0242* (2013.01)

(58) Field of Classification Search
CPC .... F02N 9/04; F02N 2019/002; F02D 19/021; F02D 33/006; F02D 41/0027; F02D 41/062; F02M 21/0236; F02M 21/0242
See application file for complete search history.

(56) References Cited

U.S. PATENT DOCUMENTS

| | | | | |
|---|---|---|---|---|
| 1,151,987 | A * | 8/1915 | Aufuldish | F02M 1/16 123/179.9 |
| 5,699,839 | A | 12/1997 | Dehne | |
| 6,698,211 | B2 | 3/2004 | Gustafson | |
| 9,234,472 | B2 | 1/2016 | Kim et al. | |
| 9,644,551 | B2 | 5/2017 | Marscheider et al. | |
| 9,689,365 | B2 | 6/2017 | Bleyer | |
| 9,777,645 | B2 * | 10/2017 | Evans | F02N 11/108 |
| 10,801,426 | B2 | 10/2020 | Sixel et al. | |
| 2006/0239827 | A1 * | 10/2006 | Manning | F04D 25/06 417/1 |
| 2016/0333842 | A1 | 11/2016 | Sunley et al. | |
| 2016/0369711 | A1 * | 12/2016 | Evans | F02D 19/025 |
| 2019/0055904 | A1 * | 2/2019 | Kejha | F02M 21/0293 |

* cited by examiner

*Primary Examiner* — Phutthiwat Wongwian
*Assistant Examiner* — Anthony L Bacon
(74) *Attorney, Agent, or Firm* — Xsensus, LLP

(57) ABSTRACT

A delay circuit for providing natural gas to an engine and systems, components, and methods thereof can comprise a first valve to selectively pass the natural gas from a starter motor configured to start the engine; a delay volume to receive the natural gas from the first valve; and a second valve to selectively pass the natural gas from the delay volume to an inlet of the engine. The natural gas is provided to the inlet of the engine via the delay system according to a predetermined delay by controlling the first valve and the second valve to selectively pass the natural gas to the inlet of the engine according to the predetermined delay.

20 Claims, 3 Drawing Sheets

DELAY CIRCUIT FOR PROVIDING NATURAL GAS TO AN ENGINE AND SYSTEMS, ASSEMBLIES, AND METHODS THEREOF

TECHNICAL FIELD

The present disclosure relates to delay circuits for providing natural gas to an engine, and more particularly to delay circuits for delaying when natural gas used to operate a starter motor is provided to the engine, and systems, assemblies, and methods thereof.

BACKGROUND

In certain situations, it may be undesirable to provide an electric starter and related components to start an engine (e.g., a gas compression engine). Engines, therefore, may instead be started using a so-called air or pneumatic starter motor whereby high-pressure air is expanded across the starter motor to energize the starter motor and hence start the engine. Natural gas may be prevalent at the site, for instance, from natural gas already in a pipeline at the site, and thus may be used in compressed form, i.e., under high-pressure, in place of compressed air to energize the starter motor. The natural gas used to energize the starter motor (and hence start the engine) may be vented to atmosphere. However, such venting may be undesirable due to emissions of methane and other hydrocarbons that make up the natural gas into the atmosphere.

U.S. Pat. No. 9,689,365 ("the '365 patent document") describes an internal combustion engine with starting air system. The starting air system is configured to provide pressurized starting air to the cylinder and to monitor operability of the starting air system. The starting air system may have a pressurized starting air source, a starting air manifold, a starting air venting valve, and a sensing device. According to the '365 patent, the starting air venting valve is fluidly connected to the starting air manifold and configured to vent the starting air system.

SUMMARY

According to aspects of the present disclosure, a delay system for providing natural gas to an engine is disclosed or provided. The delay system can comprise a first valve to selectively pass the natural gas from a starter motor configured to start the engine; a delay volume to receive the natural gas from the first valve; and a second valve to selectively pass the natural gas from the delay volume to an inlet of the engine. The natural gas can be provided to the inlet of the engine via the delay system according to a predetermined delay by controlling the first valve and the second valve to selectively pass the natural gas to the inlet of the engine according to the predetermined delay.

In another aspect, a method is disclosed or can be implemented. The method can comprise providing to a delay chamber, under control of a controller, natural gas from a starter motor for an internal combustion engine, said providing the natural gas to the delay chamber including selectively passing the natural gas from the starter motor to the delay chamber using the controller to control at least a first valve upstream of the delay chamber; and providing, under control of the controller, the natural gas from the delay chamber to an inlet of the internal combustion engine leading to one or more combustion chambers of the internal combustion engine, said providing the natural gas to the inlet of the internal combustion engine including selectively passing the natural gas from the delay chamber to the inlet of the internal combustion engine using the controller to control at least a second valve downstream of the delay chamber. The providing of the natural gas to the inlet of the internal combustion engine can occur responsive to a determination that the internal combustion engine is running and operating at a condition compatible with the introduction of the natural gas from the delay chamber.

And in another aspect a system is disclosed or provided. The system can comprise: a compressed gas source configured to provide compressed natural gas; a starter motor configured to start an internal combustion engine using the natural gas from the compressed gas source; a delay system configured to delay providing the natural gas used to energize the starter motor to an inlet of the internal combustion engine that leads to one or more combustion chambers of the internal combustion engine; and control circuitry. The delay system can include a first pipe to receive the natural gas from the starter motor, a first three-way valve to selectively pass the natural gas from the first pipe, a delay chamber to receive the natural gas from the first three-way valve, a second three-way valve to selectively pass the natural gas from the delay chamber, and a fourth pipe to receive the natural gas from the second three-way valve and provide the natural gas to the inlet of the internal combustion engine. The control circuitry can be configured to selectively provide the natural gas from the starter motor to the inlet of the internal combustion engine according to a predetermined delay by controlling the first three-way valve and the second three-way valve to selectively pass the natural gas according to the predetermined delay.

Other features and aspects of this disclosure will be apparent from the following description and the accompanying drawings.

DETAILED DESCRIPTION

Embodiments of the disclosed subject matter relate to delay circuits for providing natural gas to an engine, and more particularly to delay circuits for delaying when natural gas used to operate a starter motor is provided to the engine, and systems, assemblies, and methods thereof.

Figure 1:
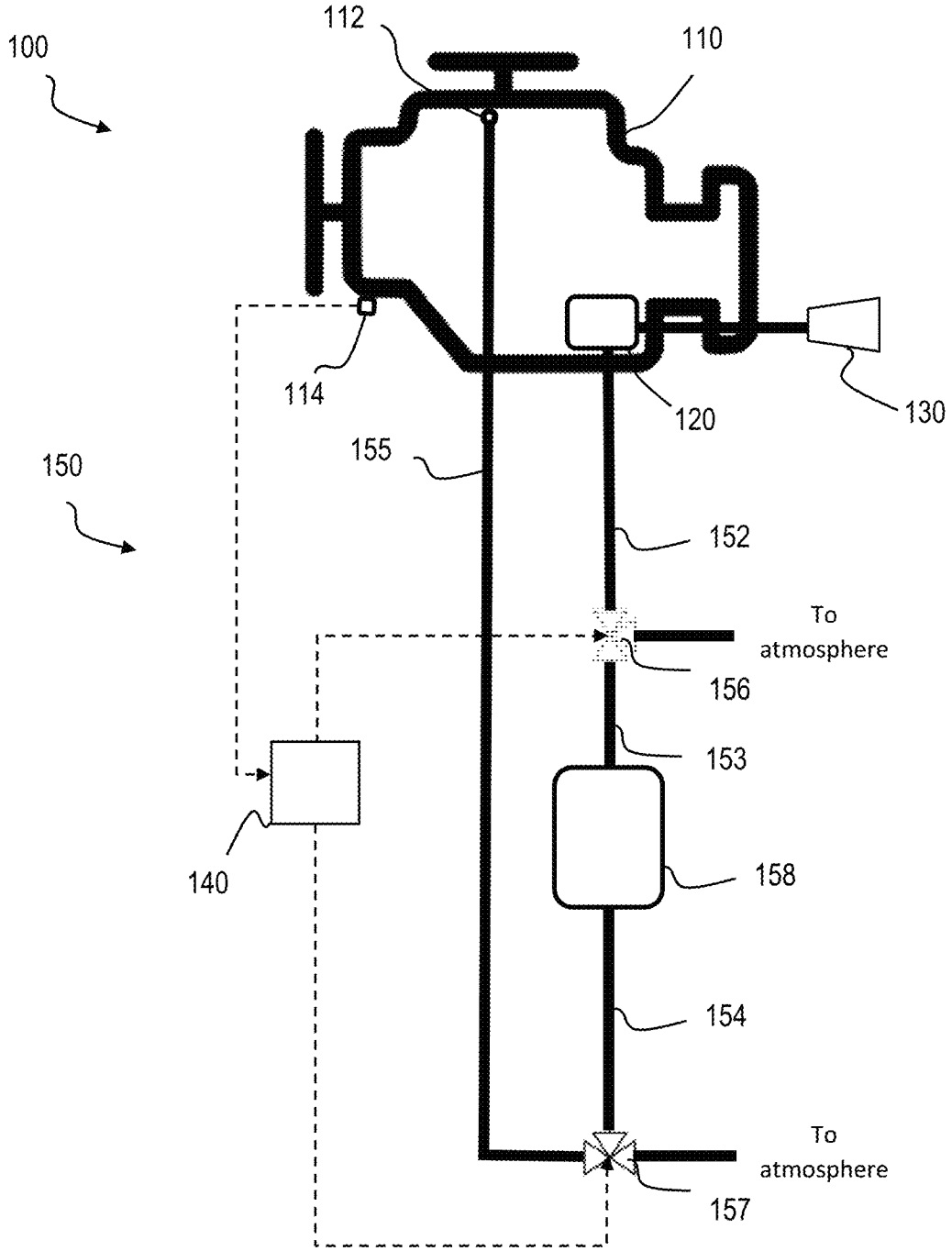
FIG. 1 is a diagram of a system according to one or more embodiments of the disclosed subject matter.

FIG. 1 is a diagram of a system 100 according to one or more embodiments of the disclosed subject matter. The system 100 can be comprised of an engine 110, a starter motor 120, a gas source 130, and a delay system 150. The system 100 may also include a controller 140, which may be implemented via control circuitry (e.g., one or more processors, computer-readable memory, etc.), and which may be referred to or characterized as an electronic control unit (ECU) or an electronic control module (ECM). Optionally, the controller 140 may be considered part of the delay system 150.

The engine 110 can be an internal combustion engine, for instance, a gas compression engine. Generally, engine 110, according to embodiments of the disclosed subject matter, can be characterized as a prime mover for gas lift, gas gathering, wellhead gas compression, pipeline compression, storage, gathering, and re-injection, though embodiments of the disclosed subject matter are not so limited.

The starter motor 120 can be configured to start the engine 110 using natural gas from the gas source 130. In this regard, the natural gas may be prevalent at the site, for instance, from natural gas already in a pipeline at the site. The natural gas provided by the gas source 130 to the starter motor 120 may be provided in compressed form, i.e., under high pressure, and expanded across the starter motor 120 to energize the starter motor 120, and hence start the engine 110. Thus, the gas source 130 may be characterized or referred to as a compressed gas source. The gas source 130, therefore, may have one or more compressors to compress the natural gas in the pipeline to provide compressed natural gas to energize the starter motor 120. According to one or more embodiments, the starter motor 120 and/or the gas source 130 can be controlled by the controller 140 to start and stop respective operations.

Generally, the system 100 can selectively provide the natural gas from the gas source 130 to the starter motor 120 and then to an inlet 112 of the engine 110 that leads to one or more combustion chambers of the engine 110. Such supply of the natural gas to the inlet 112 of the engine 110 can be according to a predetermined delay created at least in part by the delay system 150. Thus, according to embodiments of the disclosed subject matter, the natural gas used to energize the starter motor 120 may be neither provided directly to the inlet 112 of the engine 110 after passing through the starter motor 120 nor output to the atmosphere, at least before being sent through the one or more combustion chambers of the engine 110 (e.g., in a case where not all of the natural gas is able to be combusted).

The delay system 150 can be comprised of a first valve 156, a second valve 157, and a delay volume or chamber 158 between the first valve 156 and the second valve 157. The controller 140 may provide control signaling to each of the first valve 156 and the second valve 157 to control respective open/closed states. One or more conduits, such as pipes, may be provided at each input and/or each output of the first valve 156, the second valve 157, and the delay volume or chamber 158. The path taken by natural gas through the delay system 150 may be referred to or characterized as a circuit, particularly a fluid circuit.

Generally, the first valve 156 can selectively pass the natural gas from the starter motor 120 to the delay chamber 158. Control signaling from the controller 140 can control the state of the first valve 156 to selectively pass the natural gas from the starter motor 120 to the delay chamber 158.

A first conduit 152 may be between an outlet of the starter motor 120 for the natural gas from and the first valve 156. The first conduit 152 may be referred to or characterized as a pipe, particularly a first pipe. According to one or more embodiments, the first conduit 152 may be a so-called small-diameter conduit. For instance, a diameter (e.g., outer diameter) of the first conduit 152 may be from 0.5" to 3.0" (inclusive).

Separately, the first valve 156 can also selectively provide air at an input or inlet of the delay chamber 158. Thus, according to one or more embodiments, the first valve 156 can be a three-way valve, with an input to receive the natural gas from the starter motor 120, for instance, via the first conduit 152, an output to provide the natural gas from the starter motor 120 to the delay chamber 158, and an input to the surrounding environment, which may be referred to as atmosphere, to provide air to the input or inlet of the delay chamber 158. The first valve 156 can be controlled, via control signaling from the controller 140, such that none of the natural gas from the starter motor 120 is allowed to exit into the atmosphere via the first valve 156. The first valve 156, therefore, can either connect the input of the delay chamber 158 to the starter motor 120 or to the atmosphere.

According to one or more embodiments, a second conduit 153 may be between the first valve 156 and the input or inlet of the delay chamber 158. The second conduit 153 can pass the natural gas to the input or inlet of the delay chamber 158. The second conduit 153 may also allow air from the atmosphere to be provided at the input or inlet of the delay chamber 158 via the first valve 156. The second conduit 153 may be referred to or characterized as a pipe, particularly a second pipe. According to one or more embodiments, the second conduit 153 may be a so-called small-diameter conduit. For instance, a diameter (e.g., outer diameter) of the second conduit 153 may be from 0.5" to 3.0" (inclusive). Optionally, the second conduit 153 may have the same diameter(s) as the first conduit 152.

The delay chamber 158 can receive the natural gas from the first valve 156. According to one or more embodiments, the natural gas can be provided via the second conduit 153. Thus, the delay chamber 158 may be indirectly connected to the first valve 156 by way of the second conduit 153.

The delay chamber 158 can have a volume greater than a volume of the second conduit 153. The volume of the delay chamber 158 can also be greater than a volume of the first conduit 152. According to one or more embodiments, the volume of the delay chamber 158 can be greater than the volumes of the first conduit 152 and the second conduit 153 combined. Optionally, the volume of the delay chamber 158 may be greater than the volumes of all conduits of the delay system 150. Such volume of the delay chamber 158 may be greater than the volume(s) of one or more of the conduits of the delay system 150 individually or collectively by a factor of one hundred or more. The volume of the delay chamber 158 may, therefore, be referred to or characterized as a significant volume, at least when compared to the volume(s) of one or more conduits of the delay system 150.

According to one or more embodiments, the delay chamber 158 can have a volume sized to hold an entire amount of the natural gas provided to the starter motor 120 to start the engine 110. For instance, the delay chamber 158 may have a volume of 100 gallons. In any event, the volume of the delay chamber 158 may depend upon the size of the engine 110 and/or the amount of natural gas to capture (i.e., for how long the starter motor 120 is to be run via supply of compressed natural gas from the gas source 130). In that the delay chamber 158 may hold or capture the natural gas until a determination to supply such natural gas to the engine 110, the delay chamber 158 may be referred to or characterized as a holding chamber.

A third conduit 154 may be between an output or outlet of the delay chamber 158 and an input or inlet of the second valve 157. The third conduit 154 can receive the natural gas from the outlet of the delay chamber 158. The third conduit 154 may also allow air from the atmosphere to be provided at the outlet of the delay chamber 158 via the second valve 157. The third conduit 154 may be referred to or characterized as a pipe, particularly a third pipe. According to one or more embodiments, the third conduit 154 may be a so-called small-diameter conduit. For instance, a diameter (e.g., outer diameter) of the third conduit 154 may be from 0.5" to 3.0" (inclusive). Optionally, the third conduit 154 may have the same diameter(s) as the first conduit 152 and/or the second conduit 153.

Generally, the second valve 157 can selectively pass the natural gas from the delay chamber 158 to the inlet 112 of the engine 110. Control signaling from the controller 140 can control the state of the second valve 157 to selectively pass the natural gas from the delay chamber 158 to the inlet 112 of the engine 110.

A fourth conduit 155 may be between an outlet of the second valve 157 and the second valve 157. The fourth conduit 155 may be referred to or characterized as a pipe, particularly a fourth pipe. According to one or more embodiments, the fourth conduit 155 may be a so-called small-diameter conduit. For instance, a diameter (e.g., outer diameter) of the fourth conduit 155 may be from 0.5" to 3.5" (inclusive). Optionally, the fourth conduit 155 may have the same diameter(s) as the first conduit 152, the second conduit 153, and/or the third conduit 154.

Separately, the second valve 157 can also selectively provide air from the atmosphere at the outlet of the delay chamber 158. Thus, according to one or more embodiments, the second valve 157 can be a three-way valve, with an input to receive the natural gas from the delay chamber 158, for instance, via the third conduit 154, an output to provide the natural gas to the inlet 112 of the engine 110, and an input to the surrounding environment, which may be referred to as the atmosphere, to provide air at the outlet of the delay chamber 158. The second valve 156 can be controlled, via control signaling from the controller 140, such that none of the natural gas is allowed to exit into the atmosphere via the second valve 157. Thus, the second valve 157 can either connect the delay chamber 158 to the inlet 112 of the engine 110 or to the atmosphere.

The inlet 112 of the engine 110 may lead to one or more combustion chambers of the engine 110, as noted above. According to one or more embodiments of the disclosed subject matter, the inlet 112 may have or define an orifice. An inner diameter of the orifice may be less than an inner diameter of the fourth conduit 155. That is, an inner diameter of at least an output or outlet of the fourth conduit 155 can be greater than an inner diameter of the orifice.

The sizing of the orifice can be based on the size of the engine 110 and to provide the natural gas from the delay system 150 at a suitable rate for the size of the engine 110. For instance, the orifice can be sized to slow down the rate at which the natural gas is provided from the delay system 150 to the one or more combustion chambers of the engine 110. Such reduction in flow can such that the natural gas is provided to the one or more combustion chambers of the engine 110 at a predetermined rate at which the engine 110 can handle the additional fuel. For instance, the flow rate at which the natural gas is provided can be such that the control of the engine 110 can maintain the air to fuel ratio supplied to the one or more combustion chambers at a predetermined value or within a predetermined range when the additional fuel is provided. Additionally or alternatively, the flow rate at which the natural gas is provided can be such that a suitable amount (e.g., all of it or substantially all of it) of the natural gas can be combusted (i.e., consumed) when supplied to the one or more combustion chambers of the engine 110. Optionally, the orifice may be considered part of the delay system 150. In that the orifice can have cross-sectional dimensions less than the fourth conduit 155, the orifice, according to embodiments of the disclosed subject matter, may be characterized or referred to as a restricted-access orifice.

As noted above, the controller 140 can control the first valve 156 and the second valve 157 to selectively provide natural gas from the gas source 130 that is used to energize the starter motor 120 and thus start the engine 110 to the delay chamber 158 and on to the inlet 112 of the engine 110 where the natural gas can be provided to one or more combustion chambers of the engine 110. Such providing can be according to a predetermined delay caused by the delay system 150, particularly due to the control of the first valve 156 and the second valve 157 and the volume of the delay chamber 158. Such delay may also include a reduced rate of flow of the natural gas via the reduced-size orifice at or as part of the inlet 112 of the engine 110.

The natural gas may be provided to the engine 110 only after the engine 110 has been successfully started. Thus, according to one or more embodiments, the natural gas may be provided to the engine 110 only when the engine 110 is running. In this regard, a determination can be made, for instance, by the controller 140, that the engine 110 is running. As an example, the controller 140 may receive signaling from one or more sensors 114 provided to sense corresponding operating conditions of the engine 110. Such signaling can indicate that the engine 110 is running. Additionally or alternatively, the signaling may indicate that the starter motor 120 has been started or has stopped (and implicitly that the engine 110 is running). Optionally, therefore, the controller 140 can determine that the engine 110 is running a predetermined amount of time after the signaling indicates that the starter motor 120 has been started or stopped (and implicitly that the engine 110 is running).

Figure 2:
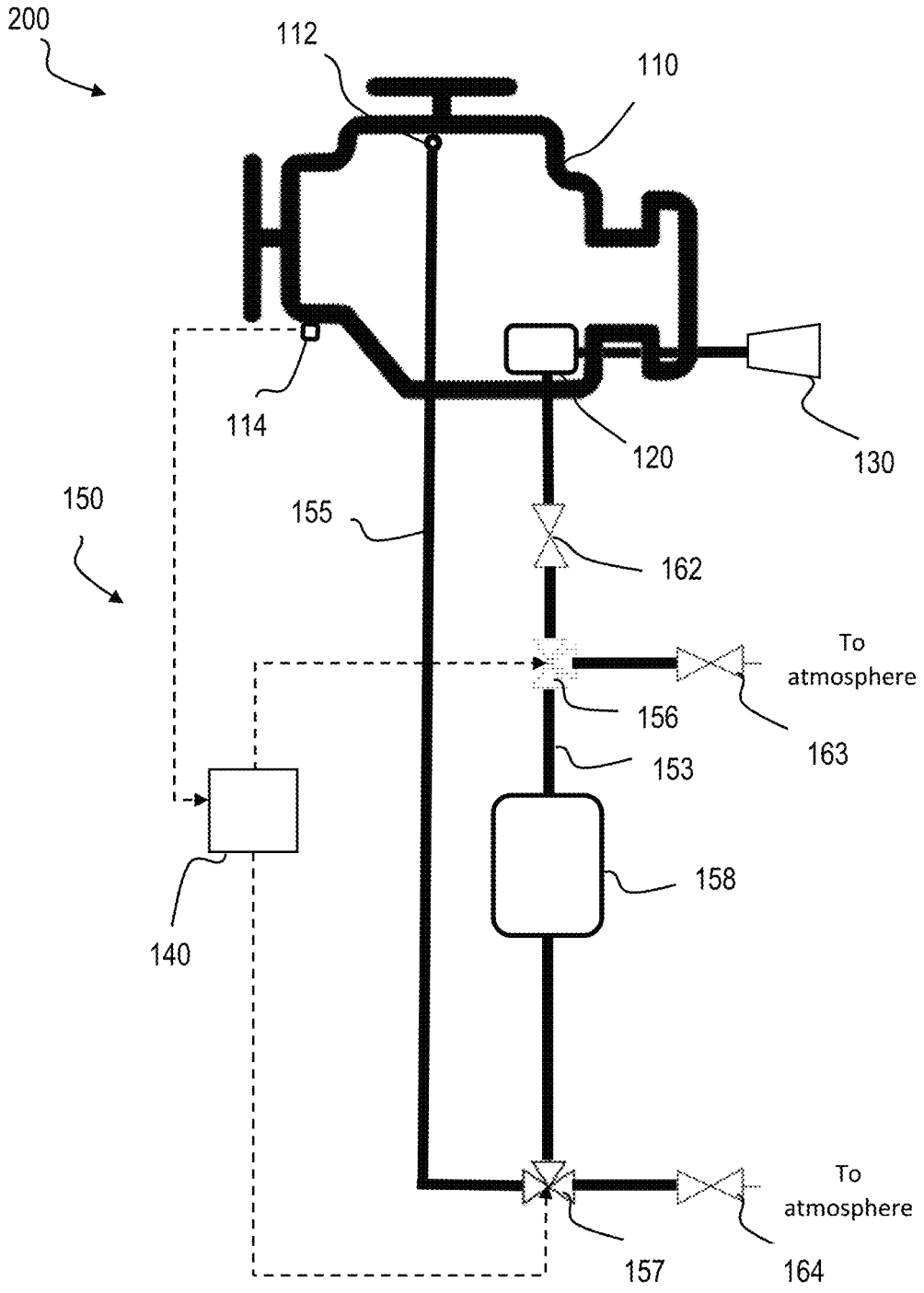
FIG. 2 is a diagram of a variation of the system of FIG. 1.

FIG. 2 is a diagram of a variation of the system 100 of FIG. 1. Notably, the system 200 of FIG. 2 can include one or more additional valves. For instance, system 200 can include one or more of a third valve 162, a fourth valve 163, and a fifth valve 164. Each of the third valve 162, the fourth valve 163, and the fifth valve 164 can be shut-off valves (i.e., ON/OFF). In the example, as shown in FIG. 2, the third valve 162 can be between the starter motor 120 and the first valve 156, the fourth valve 163 can be between the atmosphere and the first valve 156, and the fifth valve 164 can be between the atmosphere and the second valve 157. Generally, the third valve 162 can shut off flow of the natural gas to the first valve 156, whereas each of the fourth valve 163 and the fifth valve 164 can allow or prevent air from the atmosphere from reaching the first valve 156 and the second valve 157, respectively, and may even be provided as failsafe valves to prevent the natural gas from exiting to the atmosphere via either the first valve 156 or the second valve 157.

INDUSTRIAL APPLICABILITY

As noted above, the present disclosure relates to delay circuits for providing natural gas to an engine, and more particularly to delay circuits for delaying when natural gas used to operate a starter motor is provided to the engine, and systems, assemblies, and methods thereof.

Generally, embodiments of the disclosed subject matter can involve or include a delay conduit circuit (piping, valves, etc.) for transfer of gas, such as natural gas, from a volume to an engine intake such that the engine can burn the gas that may otherwise be vented to the atmosphere. Put another way, embodiments of the disclosed subject matter can capture the natural gas used to energize a starter motor to start an engine and store the natural gas until the engine is running. Once the engine is running, the stored natural gas can be fed into the engine, for instance, to provide fuel for the engine (i.e., part of the fuel for the engine) while the engine is running, thereby consuming the natural gas instead of releasing the natural gas to the atmosphere.

For instance, embodiments of the disclosed subject matter can involve a delay pipe for management of vented gas used during starting of a gas compression engine. During an engine start, the delay pipe can be connected to a volume (e.g., a delay tank or chamber) at one end and an engine intake on the other end such that the volume is large enough to store the gas used to start the engine. When the gas enters the pipe, an outlet valve can be opened, allowing air to enter the engine intake through the delay pipe. When the engine starts, the outlet valve can be closed. When the engine reaches stable operation, the outlet valve can be again opened along with a vent valve at an intake side of the volume. The vent valve can be connected to an engine boost, which can purge the stored gas into the intake of the engine. The rate of purging can be managed by the engine control system such that the purging, i.e., supplying the gas to one or more combustion chambers of the engine, does not disturb stable operation of the engine but rather uses the engine to burn the gas that may otherwise be vented to the atmosphere. Thus, according to embodiments of the disclosed subject matter, the natural gas used to energize the starter motor may be neither provided directly to the engine nor output to the atmosphere, at least before being sent through the one or more combustion chambers of the engine.

Figure 3:
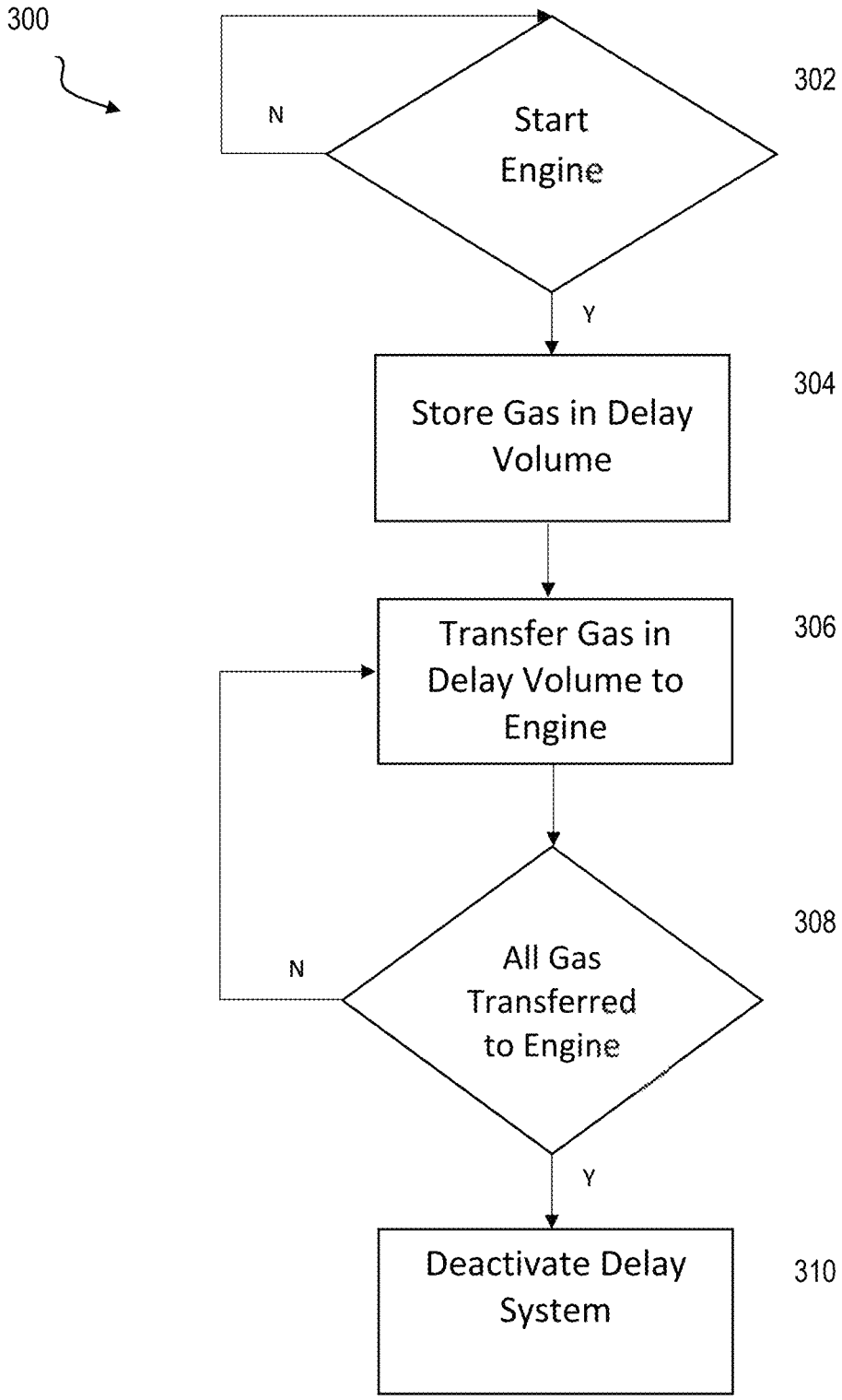
FIG. 3 is a flow chart for a method according to one or more embodiments of the disclosed subject matter.

Referring now to FIG. 3, FIG. 3 shows a flow chart for a method 300 according to one or more embodiments of the disclosed subject matter. Generally, some or all of the method may be performed under control of the controller 140, for instance. Moreover, the method 300 can be implemented using a delay system 150, such as shown in FIG. 1 or FIG. 2.

The method 300 may include an operation or step to start the engine 110. Thus, according to embodiments of the disclosed subject matter, at operation or step 302 the method 300 may continuously check to determine whether a command has been issued to start the engine 110. Such command may be provided by a user at a control panel, as an example, and furthermore may be received or identified by the controller 140 as control signaling to start the engine 110.

Upon determination that the engine 110 is to be started, the method 300 can proceed to operation or step 304. Here, at startup, if the delay chamber 158 contains air (e.g., full of air) and the starter motor 120 is operating (i.e., being supplied with pressurized natural gas from the gas source 130), the natural gas output from the starter motor 120 can be provided to the delay chamber 158 (e.g., to fill the delay chamber 158), rather than going directly to the engine 110. Moreover, the natural gas provided to the delay chamber 158 can displace the air previously in the delay chamber 158. Here, the first valve 156 can be controlled, via the controller 140, so the natural gas from the starter motor 120 is allowed to pass through the first valve 156 and enter the delay chamber 158. Additionally, the second valve 157 can be controlled, via the controller 140, so the air from the delay chamber 158 can be output to the atmosphere via the second valve 157.

Operation or step 304 of method 300 can also include, as soon as the engine 110 starts, closing the first valve 156, such that the inlet or input to the delay chamber 158 is open to atmosphere. Since both the inlet and outlet of the delay chamber 158 are now open to the atmosphere via the first valve 156 and the second valve 157, respectively, no flow may exist through the delay volume 158 and the natural gas can be retained in the delay chamber 158.

At operation or step 306, as soon as the engine 110 is running (e.g., determined to be running, including passage of a predetermined amount of time), the second valve 157 can be controlled, using the controller 140, to expose the delay chamber 158 to the inlet 112 of the engine 110 (via fourth conduit 155 and third conduit 154). This can cause the natural gas to be expelled from the delay chamber 158 into the engine 110 via the inlet 112. Such operation 306, because the first valve 156 can still be open to the atmosphere, can draw air from the atmosphere into the delay chamber 158, where the air being drawn into the delay chamber 158 can force the natural gas from the delay chamber 158 to the inlet 112 of the engine 110.

The method 300 can then include determining whether all of the natural gas stored in the delay chamber 158 has been transferred to the engine 110 via the inlet 112. This determination can be based on expiration of a predetermined amount of time, for instance, based on the amount of natural gas provided to the delay chamber 158 (which may be based on the maximum volume of the delay chamber 158). The controller 140 may make this determination.

Upon determining that all of the natural gas stored in the delay chamber 158 has been transferred to the engine 110, the method 300, at operation or step 310, can deactivate the delay system 150. Deactivation can include controlling, using the controller 140, the first valve 156 and the second valve 157 (and optionally the fourth valve 163 and the fifth valve 164) to expose the inlet and the outlet, respectively, to the atmosphere. The method 300 may return to operation 302 to wait for the next command to start the engine 110.

The foregoing disclosure provides illustration and description, but is not intended to be exhaustive or to limit the implementations to the precise forms disclosed. Modifications and variations may be made in light of the above disclosure or may be acquired from practice of the implementations. Furthermore, any of the implementations described herein may be combined unless the foregoing disclosure expressly provides a reason that one or more implementations cannot be combined. Even though particular combinations of features are recited in the claims and/or disclosed in the specification, these combinations are not intended to limit the disclosure of various implementations. Although each dependent claim listed below may directly depend on only one claim, the disclosure of various implementations includes each dependent claim in combination with every other claim in the claim set.

While aspects of the present disclosure have been particularly shown and described with reference to the embodiments above, it will be understood by those skilled in the art that various additional embodiments may be contemplated by the modification of the disclosed machines, assemblies, systems, and methods without departing from the spirit and scope of what is disclosed. Such embodiments should be understood to fall within the scope of the present disclosure as determined based upon the claims and any equivalents thereof.

As used herein, "a" and "an" are intended to include one or more items, and may be used interchangeably with "one or more." Further, as used herein, the article "the" is intended to include one or more items referenced in connection with the article "the" and may be used interchangeably with "the one or more." Further, the phrase "based on" is intended to mean "based, at least in part, on" unless explicitly stated otherwise. Also, as used herein, the term "or" is intended to be inclusive when used in a series and may be used interchangeably with "and/or," unless explicitly stated otherwise (e.g., if used in combination with "either" or "only one of").

The invention claimed is:

1. A system comprising:

a compressed gas source configured to provide compressed natural gas;

a starter motor configured to start an internal combustion engine using the natural gas from the compressed gas source;

a delay system configured to delay providing the natural gas used to energize the starter motor to an inlet of the internal combustion engine that leads to one or more combustion chambers of the internal combustion engine, the delay system including:

a first pipe to receive the natural gas from the starter motor, a first three-way valve to selectively pass the natural gas from the first pipe, a delay chamber to receive the natural gas from the first three-way valve, a second three-way valve to selectively pass the natural gas from the delay chamber, and a fourth pipe to receive the natural gas from the second three-way valve and provide the natural gas to the inlet of the internal combustion engine; and control circuitry configured to selectively provide the natural gas from the starter motor to the inlet of the internal combustion engine according to a predetermined delay by controlling the first three-way valve and the second three-way valve to selectively pass the natural gas according to the predetermined delay.

2. The system according to claim 1, wherein the control circuitry is configured to provide the natural gas to the inlet of the internal combustion engine only when the internal combustion engine is running.

3. The system according to claim 1, wherein the control circuitry is configured to provide the natural gas to the inlet of the internal combustion engine only after a predetermined amount of time has passed since the internal combustion engine has been started by the starter motor.

4. The system according to claim 1, further comprising:

a second pipe between the first three-way valve and the delay chamber; and a third pipe between the delay chamber and the second three-way valve, wherein the delay chamber defines a volume greater than a total volume of the first pipe, the second pipe, the third pipe, and the fourth pipe.

5. The system according to claim 1, wherein the delay chamber has a volume sized to hold an entire amount of the natural gas provided to the starter motor to start the internal combustion engine.

6. The system according to claim 1, wherein an inner diameter of an outlet of the fourth pipe is greater than an inner diameter of the inlet of the internal combustion engine leading to the one or more combustion chambers.

7. The system according to claim 1, wherein the control circuitry is configured control the first three-way valve and the second three-way valve to expose each of the first three-way valve and the second three-way valve to atmosphere without allowing any of the natural gas to escape to the atmosphere via either the first three-way valve or the second three-way valve.

8. The system according to claim 1, further comprising:

a first shutoff valve between the first three-way valve and the starter motor;

a second shutoff valve between the first three-way valve and the atmosphere; and a third shutoff valve between the second three-way valve and the atmosphere.

9. A method comprising:

providing to a delay chamber, under control of a controller, natural gas from a starter motor for an internal combustion engine, said providing the natural gas to the delay chamber including selectively passing the natural gas from the starter motor to the delay chamber using the controller to control at least a first valve upstream of the delay chamber; and providing, under control of the controller, the natural gas from the delay chamber to an inlet of the internal combustion engine leading to one or more combustion chambers of the internal combustion engine, said providing the natural gas to the inlet of the internal combustion engine including selectively passing the natural gas from the delay chamber to the inlet of the internal combustion engine using the controller to control at least a second valve downstream of the delay chamber, wherein said providing the natural gas to the inlet of the internal combustion engine occurs responsive to a determination that the internal combustion engine is running and operating at a condition compatible with the introduction of the natural gas from the delay chamber.

10. The method according to claim 9, further comprising determining, using the controller, whether the internal combustion engine is running.

11. The method according to claim 9, wherein said providing the natural gas to the inlet of the internal combustion engine occurs responsive to a determination that a predetermined amount of time has passed since starting the internal combustion engine using the starter motor supplied with the natural gas from a compressed gas source.

12. The method according to claim 9, further comprising:

controlling, using the controller, for said providing the natural gas to the delay chamber, the first valve and the second valve to expel air in the delay chamber to atmosphere via the second valve; and controlling, using the controller, for said providing the natural gas to the inlet of the internal combustion engine, the first valve and the second valve to expel the natural gas from the delay chamber to the inlet of the internal combustion engine.

13. The method according to claim 9, further comprising performing a deactivation operation, after a predetermined amount of time of providing the natural gas to the inlet of the internal combustion engine, under control of the controller.

14. The method according to claim 9, wherein said providing the natural gas to the inlet of the internal combustion engine includes slowing down flow of the natural gas via an orifice having a restricted cross-section relative to a cross-section of a conduit between the second valve and the inlet of the internal combustion engine.

15. A delay system for providing natural gas to an engine comprising:

a first valve to selectively pass the natural gas from a starter motor configured to start the engine;

a delay volume to receive the natural gas from the first valve; and a second valve to selectively pass the natural gas from the delay volume to an inlet of the engine, wherein the natural gas is provided to the inlet of the engine via the delay system according to a predetermined delay by controlling the first valve and the second valve to selectively pass the natural gas to the inlet of the engine according to the predetermined delay.

16. The delay system according to claim 15, further comprising control circuitry configured to selectively provide the natural gas to the inlet of the engine according to the predetermined delay by controlling the first valve and the second valve to selectively pass the natural gas according to the predetermined delay.

17. The delay system according to claim 16, wherein the control circuitry is configured to provide the natural gas to the inlet of the engine only when the engine is running.

18. The delay system according to claim 15, further comprising an orifice to slow down a flow of the natural gas through the inlet of the engine.

19. The delay system according to claim 15, further comprising:

a first conduit between the starter motor and the first valve;

a second conduit between the first valve and the delay volume;

a third conduit between the delay volume and the second valve; and a fourth conduit between the second valve and the inlet to the engine, wherein the delay volume is defined by a delay chamber having a volume greater than a total volume of the first conduit, the second conduit, the third conduit, and the fourth conduit, and wherein the volume of the delay chamber is sized to hold an entire amount of the natural gas provided to the starter motor to start the engine.

20. The delay system according to claim 15, further comprising:

a first shutoff valve between the first valve and the starter motor;

a second shutoff valve between the first valve and atmosphere; and/or a third shutoff valve between the second valve and the atmosphere.

* * * * *